United States Patent [19]

Lew

[11] 4,452,025

[45] Jun. 5, 1984

[54] SELF-INTERLOCKING GRILLE

[76] Inventor: Hyok S. Lew, 7890 Oak St., Arvada, Colo. 80005

[21] Appl. No.: 206,303

[22] Filed: Nov. 12, 1980

Related U.S. Application Data

[63] Continuation-in-part of Ser. No. 58,556, Jul. 18, 1979, Pat. No. 4,282,695.

[51] Int. Cl.[3] ..... E04C 2/42

[52] U.S. Cl. ..... 52/668; 52/665

[58] Field of Search ..... 52/664–669; 428/131, 116; 217/31

[56] References Cited

U.S. PATENT DOCUMENTS

| | | | |
|---|---|---|---|
| 1,140,657 | 5/1915 | Benjamins | 52/667 |
| 1,309,698 | 7/1919 | Scherbner | 52/668 |
| 1,896,957 | 2/1933 | Hutcheson | 52/665 |
| 2,069,391 | 2/1937 | Sample | 52/668 |
| 2,171,358 | 8/1939 | Gall | 428/116 |
| 2,680,501 | 6/1954 | Cunningham | 52/665 |
| 3,444,568 | 5/1969 | Vogelsang | 428/116 |

FOREIGN PATENT DOCUMENTS

| | | | |
|---|---|---|---|
| 601726 | 7/1960 | Canada | 52/664 |
| 660199 | 7/1933 | Fed. Rep. of Germany | 52/668 |
| 30097 | 6/1933 | Netherlands | 52/668 |
| 120221 | 11/1947 | Sweden | 52/664 |

*Primary Examiner*—Henry E. Raduazo

[57] ABSTRACT

A plurality of metallic or plastic strips or flats or bars with a certain types of notches and holes disposed along the length of said strips or flats or bars in a regular interval, which are used together with a plurality of rods in assembling a variety of self-interlocking grilles, are disclosed.

8 Claims, 12 Drawing Figures

SELF-INTERLOCKING GRILLE

This is a continuation-in-part application of a patent application Ser. No. 58,556 entitled "Self-interlocking Grille" filed on July 18, 1979 and now U.S. Pat. No. 4,282,695.

Many different types of the metalic or plastic grille works employed in the building construction for many different purposes such as the fences, safety screens, guard rails, partitions, shelves, air duct covers, gratings, etc. have to be custom fabricated because of varying sizes required for different applications. As a consequence, these items of seemingly simple and primitive handicraft command very high prices that eliminates many average consumers from using them. The cost of grille works can be drastically lowered by mass producing the grille components that can be purchased in bundles and assembled by the users without requiring any special tools or fasteners. A greater use of the grille works in private dwellings as well as the public buildings can add to the safety and security of the people as well as the eye pleasing effect in terms of decoration.

The primary object of the present invention is to provide the grille components that can be assembled into a grille work without using any welding or fasteners.

Another object of the present invention is to provide the self-interlocking grilles which is sturdy and strong and can not be disassembled without using special tools. A further object of the present invention is to provide the self-interlocking grilles of which size can be easily varied.

These and other objects of the present invention will become clear as the description and specification of the present invention proceeds. The present invention may be described with great clarity and specificity by referring to the FIGS. 1 through 9 showing a plurality of embodiment of the principles of the present invention.

Once more, this applicant would like to express his deep appreciation for the thoughfulness and open minded approach that Mr. Raduazo has displayed in examining the outstanding patent application.

Figure 1:
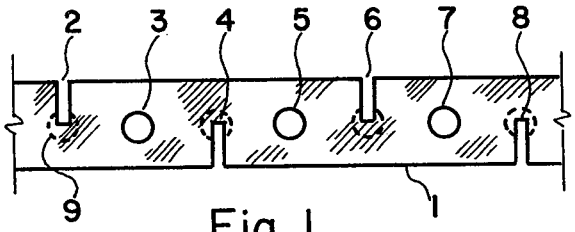
FIG. 1 illustrates plan view of the bar employed in the construction of the self-interlocking grill taught by the present invention, of which embodiments are shown in FIGS. 9, 10, 11 or 12.
Figure 2:
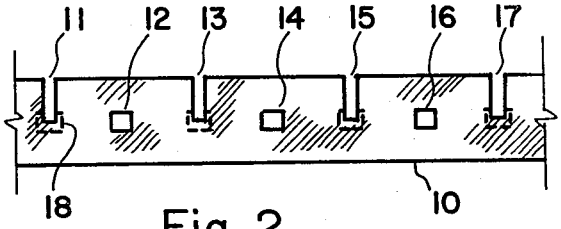
FIG. 2 illustrates a plan view of another bar employed in the construction of the self-interlocking grill.
Figure 9:
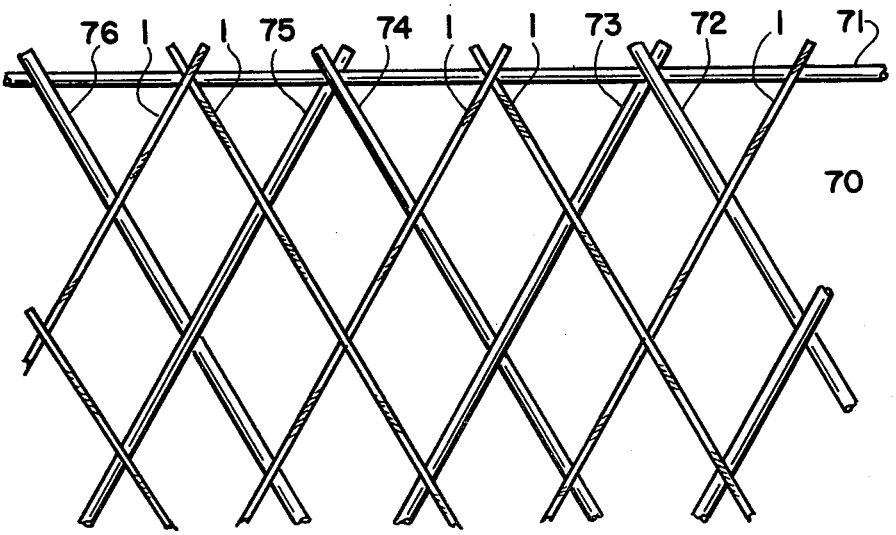
FIG. 9 illustrates a plan view of an embodiment of the self-interlocking grill constructed in accordance with the principle of the present invention.

In FIG. 1, there is shown a flat or strip or bar 1 having a series of round holes 3, 5, 7, etc., disposed in alternating pattern at a regular intervals, wherein the notches are cut on both edges in alternating fashion. In general, the width of said notches are about two times of the thickness of said flat or strip or bar 1 and its depth is equal to one half of the width of said flat or strip or bar 1. Each of the notches 2, 6, 8 etc. are provided with a stitch cut or pressed inprint or circular shape 9 at the closed end, that can be easily punched out to change the notches of the rectangular geometry to that of a key hole shape. In FIG. 9, there is shown a self-interlocking grille 70 made of a plurality of strips or flats or bars 1 shown in FIG. 1 and a plurality of rods 71, 72, 73, 74, 75, 76 etc. The bars 1 are interwoven to each other first to form a diagonal or square grid work and then rods are threaded through the round holes on bars parallel to the bars wherein the rods are also interwoven to each other. The notches adjacent to the end of each bars are converted to key holes by removing the circular imprints 9 and the rod 71 is threaded through a series of circular holes provided by each pair of key holes mated to one another, which provides secure edge of the grille without employing any weld or fasteners along the edge of the grille.

There is shown another embodiment of the flats or strips or bars 10 used to make another type of self-interlocking grille. In said embodiment, a series of rectangular notches 11, 13, 15, 17 etc. with a rectangular or square imprints 18 and a series of rectangular or square holes 12, 14, 16, etc., are disposed along the length of said bar 10 in alternating fashion at the regular intervals. Here, all notches are provided on one edge of the bar 10 and the rectangular or square imprints 18 can be easily punched out to convert the rectangular notches to key hole shaped notches. It is not difficult to see that these bars 10 and rods of square cross sections can be assembled to a self-interlocking grille essentially similar to that shown in FIG. 9. Of course, in this case, the bars are not interwoven, while the rods are still interwoven to each other.

Figure 3:
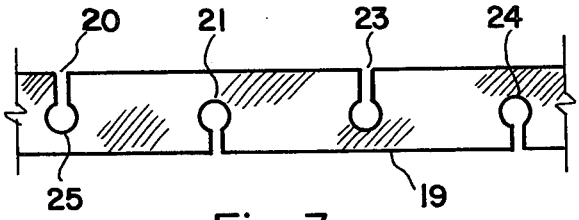
FIG. 3 illustrates a plan view of a further bar employed in the construction of the self-interlocking grill.
Figure 4:
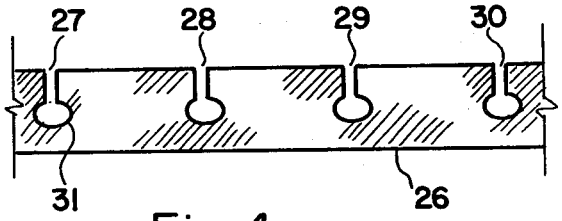
FIG. 4 illustrates a plan view of still another bar employed in the construction of the self-interlocking grill.

In FIG. 3, there is shown a strip or flat or bar 19 having a series of key-hole shaped notches 20, 21, 23, 24, etc., cut out on both edges in an alternating fashion at the regular intervals, wherein the round hole 25 disposed at the closed end of the rectangular notch is of circular or near circular geometry. In FIG. 4, there is shown a strip or flat or bar 26 with a series of key-hole shaped notches 27, 28, 29, 30 etc. cut out on edge at equal intervals. The round holes 31 disposed at the closed end of each notches are of elliptical geometry.

Figure 11:
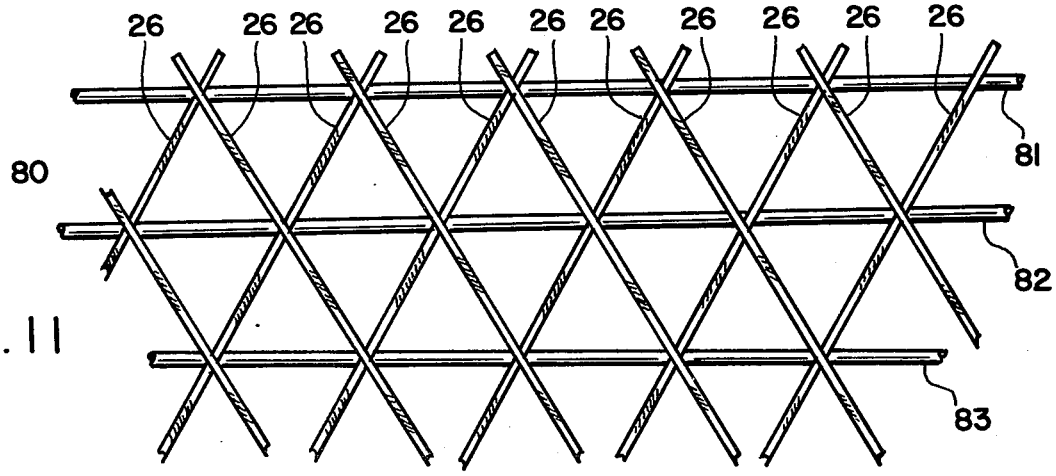
FIG. 11 illustrates a plan view of a further embodiment of self-interlocking grill.
Figure 12:
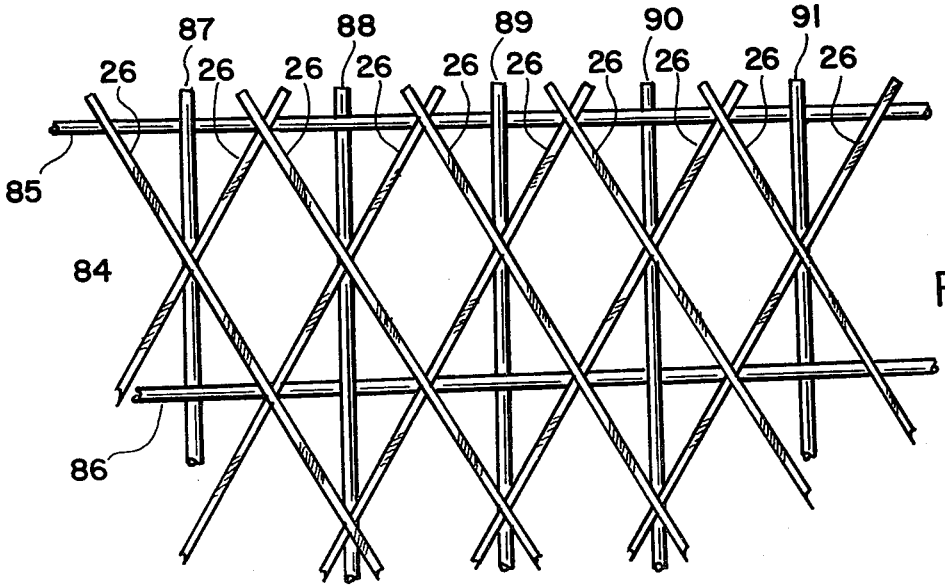
FIG. 12 illustrates a plan view of still another embodiment of the self-interlocking grill.

It can be readily visualized that the bars 19 or 26 respectively shown in FIGS. 3 and 4 can be used together with a plurality of round rods to form the self-interlocking grilles 80 and 84 shown in FIGS. 11 and 12 wherein the round rods are designated as 81, 82, 83, etc., in FIG. 11 and as 85, 86, 87, 88, 89, 90, 91 etc., in FIG. 12.

Figure 5:
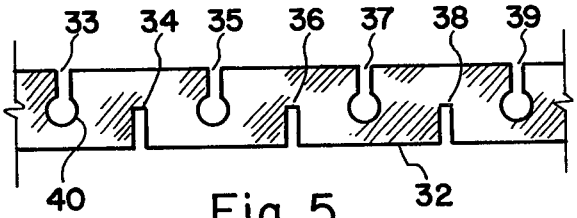
FIG. 5 illustrates a plan view of a still another bar employed in the construction of the self-interlocking grill.
Figure 6:
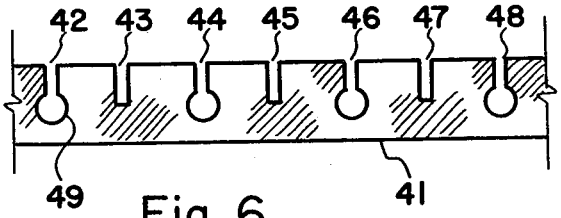
FIG. 6 illustrates a plan view of yet another bar employed in the construction of the self-interlocking grill.
Figure 7:
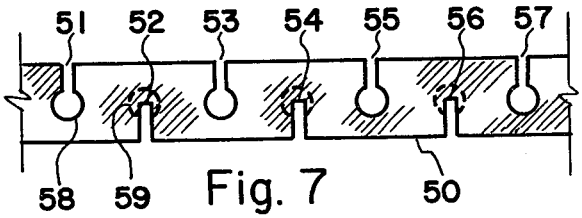
FIG. 7 illustrates a plan view of a yet further bar employed in the construction of the self-interlocking grill.
Figure 8:
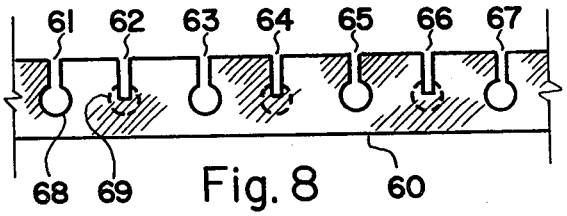
FIG. 8 illustrates a plan view of an additionally further bar employed in the construction of the self-interlocking grill.
Figure 10:
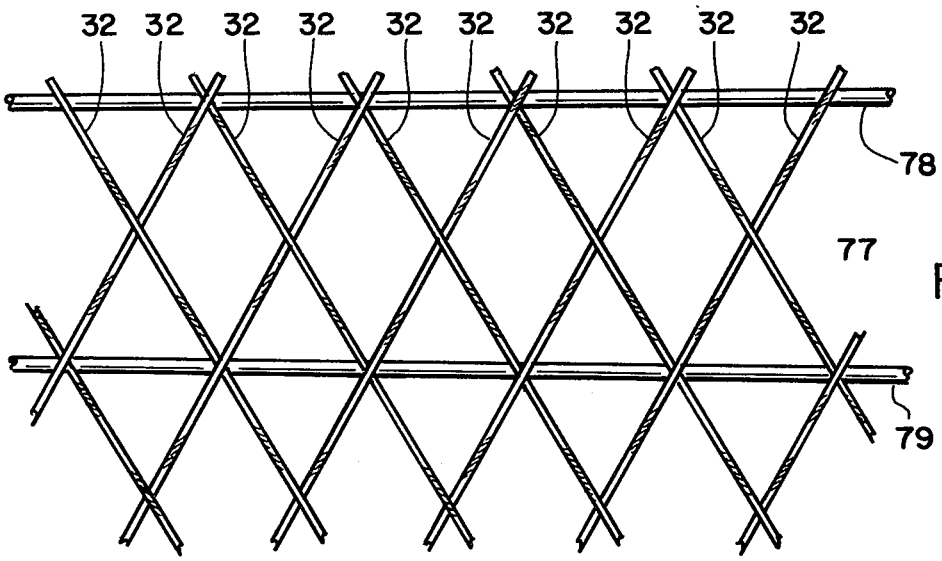
FIG. 10 illustrates a plan view of another embodiment of the self-interlocking grill.

In FIG. 5, there is shown a strip or flat or bar 32 with a series of key-hole shaped cut outs 33, 35, 37, 39, etc., provided on one edge and a series of rectangular notches 34, 36, 38, etc., provided on other edge, wherein the key-hole shaped cutout and the rectangular notches are disposed in alternating fashion at the regular intervals. In FIG. 6, there is shown strip or flat or bar 41 having a series of key-hole shaped cutouts 42, 44, 46, 48 etc., and a series of rectangular notches 43, 45, 57 etc., provided on the same side edge in alternating fashion at the regular intervals. The key-hole openings 40 or 49 may be of circle or rectangle or elliptic geometry. The plurality of these bars 32 together with rods 78, 79 etc., are employed to form a grille assembly 77 shown in FIG. 10. The plurality of bars 41 and rods may be used to assemble grille works similar to that shown in FIG. 10. There is shown in FIG. 7 strip or flat or bar 50 with the key-hole shaped cutouts 51, 53, 55, 57 etc., and rectangular notches 52, 54, 56, etc., provided with a circular imprint 59 at the closed end of each of said rectangular notches that can be punched out. Therefore, bars 50 can be used to form a grille 77 shown in FIG. 10 or grilles 80 or 84 shown in FIGS. 11 and 12, respectively. The arrangement of circular imprints 69 provided at the closed end of rectangular notches 62, 64, 66 etc., on strip or flat or bar 60 of FIG. 8 enables said bar 60 to function as a bar 41 of FIG. 6 or bar 26 of FIG. 4 and, consequently, such bars 60 can be used to make grilles similar to those shown in FIGS. 10, 11 or 12.

It is obvious that by not using some circular holes or rectangular notches on the bars employed in aseembling the grille works shown in FIGS. 9, 10, 11 and 12, one can come up with a variety of grilles of different patterns.

While the principles of the invention have been made clear in an illustrative embodiment, there will be immediately obvious to those skilled in this type of work or those with sharp eyes many modifications of the structure, arrangement, proportions, the elements, materials and components used in the practice of the invention which are particularly adapted for the specific environments and operating requirements without departing from those principles.

I claim:

1. A self-interlocking grill comprising in combination:

(a) a first plurality of bars having opposite edges, said plurality of bars disposed parallel to each other in first direction, each of said plurality of bars including;

(1) series of notches extending inwardly from said edges in alternating fashion, each of said notches having an open and closed end with an imprint of a hole provided at the closed end thereof; and (2) a series of holes disposed along the middle of said strip at the midpoints between adjacent notches;

(b) a second plurality of bars having opposite edges, said plurality of bars disposed parallel to one another in second direction, each of said plurality of bars including;

(1) a series of notches extending inwardly from said edges in alternating fashion, each of said notches having an open and closed end with an imprint of a hole provided at the closed end thereof; and (2) a series of holes disposed along the middle of said strip at the midpoints between adjacent notches; wherein said first and second plurality of bars cross each other and said notches included in said first plurality of bars engage said notches included in said second plurality of bars;

(c) a first plurality of rods disposed parallel to one another in said first direction, each of said first plurality of rods engaging and extending through a series of said holes included in said second plurality of bars wherein said first plurality of rods and said first plurality of bars are disposed parallel to each other in alternating fashion;

(d) a second plurality of rods disposed parallel to one another in said second direction, each of said second plurality of rods engaging and extending through a series of said holes included in said first plurality of bars wherein said second plurality of rods and said second plurality of bars are disposed parallel to each other in alternating fashion.

2. A self-interlocking grill comprising in combination:

(a) a first plurality of bars disposed parallel to each other in first direction and a second plurality of bars disposed parallel to each other in second direction, each of said first and second plurality of bars having opposite edges and including;

(1) a series of notches extending inwardly from said edges in alternating fashion, each of said notches having an open and closed end with a hole provided at the closed end thereof; and (2) a series of holes disposed along the middle of said strip at the midpoints between adjacent notches; wherein said first and second plurality of bars cross each other and said notches included in said first plurality of bars engage said notches included in said second plurality of bars; and (b) a first plurality of rods disposed parallel to said first plurality of bars in alternating fashion wherein each of said first plurality of rods engages and extends through a series of said holes included in said second plurality of bars, and a second plurality of rods disposed parallel to said second plurality of bars in alternating fashion wherein each of said second plurality of rods engages and extends through a series of said holes included in said first plurality of bars.

3. A self-interlocking grill comprising in combination:

(a) a first plurality of bars disposed parallel to each other in first direction and a second plurality of bars disposed parallel to each other in second direction, each of said first and second plurality of bars having opposite edges and including;

(1) a series of notches extending inwardly from one of said opposite edges, each of said notches having an open and closed end with an imprint of a hole provided at the closed end thereof; and (2) a series of holes disposed along the middle of said strip at the midpoints between adjacent notches; wherein said first and second plurality of bars cross each other and said notches included in said first plurality of bars engage said notches included in said second plurality of bars; and (b) a first plurality of rods disposed parallel to said first plurality of bars in alternating fashion wherein each of said first plurality of rods engages and extends through a series of said holes included in said second plurality of bars, and a second plurality of rods disposed parallel to said second plurality of bars in alternating fashion wherein each of said second plurality of rods engages and extends through a series of holes included in said first plurality of bars.

4. A self-interlocking grill comprising in combination:

(a) a first plurality of bars disposed parallel to each other in first direction and a second plurality of bars disposed parallel to each other in second direction, each of said first and second plurality of bars having opposite edges and including;

(1) a series of notches extending inwardly from one of said opposite edges, each of said notches having an open and closed end with a hole provided at the closed end thereof; and (2) a series of holes disposed along the middle of said strip at the middle points between adjacent notches; wherein said first and second plurality of bars cross each other and said notches included in said first plurality of bars engage said notches included in said second plurality of bars; and (b) a first plurality of rods disposed parallel to said first plurality of bars in alternating fashion wherein each of said first plurality of rods engages and extends through a series of said holes included in said second plurality of bars, and a second plurality of rods disposed parallel to said second plurality of bars in alternating fashion wherein each of said second plurality of rods engages and extends through a series of said holes included in said first plurality of bars.

5. A self-interlocking grill comprising in combination:

(a) a first plurality of bars disposed parallel to each other in first direction and a second plurality of bars disposed parallel to each other in second direction, each of said first and second plurality of bars having opposite edges and including a series of notches extending inwardly from said edges in alternating fashion, each of said notches having an open and closed end with a hole provided at the closed end thereof; wherein said first and second plurality of bars cross each other and said notches included in said first plurality of bars engage said notches included in said second plurality of bars providing a hole at each intersection of two crossing bars; and (b) a plurality of rods disposed parallel to each other in third direction oblique to said first and second directions wherein each of said plurality of rods engages and extends through a series of holes provided at the intersections of two crossing bars.

6. A self-interlocking grill comprising in combination:

(a) a first plurality of bars disposed parallel to each other in first direction and a second plurality of bars disposed parallel to each other in second direction, each of said first and second plurality of bars having opposite edges and including a series of notches extending inwardly from one of said opposite edges, each of said notches having an open and closed end with a hole provided at the closed end thereof; wherein said first and second plurality of bars cross each other and said notches included in said first plurality of bars engage said notches included in said second plurality of bars providing a hole at each intersection of two crossing bars; and (b) a plurality of rods disposed parallel to each other in third direction oblique to said first and second directions wherein each of said plurality of rods engages and extends through a series of holes provided at the intersections of two crossing bars.

7. A self-interlocking grille comprising in combination:

(a) a first plurality of bars disposed parallel to each other in first direction and a second plurality of bars disposed parallel to each other in second direction, each of said first and second plurality of bars having opposite edges and including a series of notches extending inwardly from said edges in alternating fashion, each of said notches having an open and closed end with a hole provided at the closed end thereof; wherein said first and second plurality of bars cross each other and said notches included in said first plurality of bars engage said notches included in said second plurality of bars providing a hole at each intersection of two crossing bars; and (b) a first plurality of rods disposed parallel to each other in third direction oblique to said first and second directions wherein each of said first plurality of rods engages and extends through an alternative series of holes provided at the intersections of two crossing bars; and (c) a second plurality of rods disposed parallel to each other in fourth direction substantially perpendicular to said third direction wherein each of said second plurality of rods engages and extends through another alternative series of holes provided at the intersections of two crossing bars.

8. A self-interlocking grille comprising in combination:

(a) a first plurality of bars disposed parallel to each other in first direction and a second plurality of bars disposed parallel to each other in second direction, each of said first and second plurality of bars having opposite edges and including a series of notches extending inwardly from one of said opposite edges, each of said notches having an open and closed end with a hole provided at the closed end thereof; wherein said first and second plurality of bars cross each other and said notches included in said first plurality of bars engage said notches included in said second plurality of bars providing a hole at each intersection of two crossing bars; and (b) a first plurality of rods disposed parallel to each other in third direction oblique to said first and second directions wherein each of said first plurality of rods engages and extends through an alternative series of holes provided at the intersections of two crossing bars; and (c) a second plurality of rods disposed parallel to each other in fourth direction substantially perpendicular to said third direction wherein each of said second plurality of rods engages and extends through another alternative series of holes provided at the intersections of two crossing bars.

* * * * *